United States Patent [19]

Koch et al.

[11] 4,074,982

[45] Feb. 21, 1978

[54] PROCESS AND MEANS FOR GRINDING OUT FAULTS IN THE SURFACE OF A WORK PIECE

[75] Inventors: Heinz Koch, Sprockhovel; Manfred Pawlowicz; Bernhard Brams, both of Schermbeck-Damm, all of Germany

[73] Assignee: Fried Krupp Huttenwerke AG, Bochum, Germany

[21] Appl. No.: 769,003

[22] Filed: Feb. 16, 1977

[30] Foreign Application Priority Data

Feb. 20, 1976 Germany ..... 2606853

[51] Int. Cl.[2] ..... B24B 7/02; B24B 1/00

[52] U.S. Cl. ..... 51/92 R; 51/165.77; 51/327

[58] Field of Search ..... 51/34 C–34 G, 51/92 R, 281 R, 327, 165.77, 165.92, 35, 322; 83/371

[56] References Cited

U.S. PATENT DOCUMENTS

| | | | |
|---|---|---|---|
| 3,354,587 | 11/1967 | Janis | 51/35 |
| 3,641,709 | 2/1972 | Gazuit | 51/34 D |
| 3,774,353 | 11/1973 | Yasunaga | 51/322 |
| 3,862,517 | 1/1975 | Porter | 51/281 R |
| 3,953,943 | 5/1976 | Nakaoka | 51/34 E |

*Primary Examiner*—Gary L. Smith
*Assistant Examiner*—Nicholas P. Godici
*Attorney, Agent, or Firm*—Haseltine, Lake & Waters

[57] ABSTRACT

An apparatus and process for grinding out faults on the surface of a ferromagnetic workpiece includes the step of placing a grinding device on the workpiece, magnetizing the workpiece by a magnetizing device, sensing surface faults in the magnetized workpiece by first and second sensing elements placed above first and second check points and grinding the sensed surface faults of the magnetized workpiece by the grinding device. The workpiece is operatively and repeatedly transported in one direction with respect to the first and second elements and the grinding device, and repeatedly returned in a direction opposite to the first direction. The ground workpiece is tested for faults at the first and second check points, and the first and second checkpoints are arranged behind and in front of the grinding device, respectively, with respect to the opposite direction of movement of the workpiece. The workpiece is additionally ground in dependence of the fault detected at the first check point, and repeatedly ground until no further fault is detected at the second check point.

10 Claims, 1 Drawing Figure

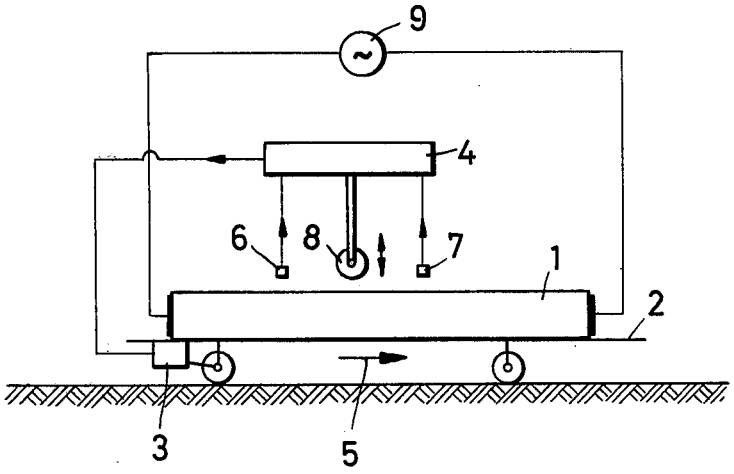
9
4
6
8
7
1
2
3
5

PROCESS AND MEANS FOR GRINDING OUT FAULTS IN THE SURFACE OF A WORK PIECE

BACKGROUND OF THE INVENTION

It is known that faults, for example cracks, in the surface of a workpiece reappear after a forming process on the surface of the formed workpiece. Furthermore, faults can arise on a previously perfect workpiece through the forming process or the heating prior to these processes. For the removal of such faults it is necessary first to recognize and mark these faults so that they can be ground out.

There are various processes for establishing and marking the faults. In one known process a magnetic induction is produced in the workpiece. The magnetic field is disturbed at the points where there are surface faults. This effect is detected either by means of sensing elements in the form of coils or magnetic tapes and, for example, by spraying on color, or is simply distinguished by magnetic powder being scattered on the whole of the surface. The distribution of magnetic powder can be differentiated on the points where there are surface faults from the distribution of the faultless areas of the surface, thus, enabling these points to be marked manually. This marking, however, is lost if an operator operates the grinding device at the point where the fault is to be found. This is disadvantageous, for the operator often cannot recognize, or at least can only recognize with great difficulty, whether the grinding process is sufficient to completely remove the fault. It is therefore necessary to re-check the workpiece after grinding and to regrind the workpiece if it still shows faults.

OBJECT OF THE INVENTION

The object of the invention is to provide a process and a means for grinding out faults in the surface of a workpiece which can be at least partly, but preferably completely, automated and in which the individual areas of the workpiece are not removed from the operating regions of the grinding device until faults in this area have been completely removed.

SUMMARY OF THE INVENTION

This object is attained by means of a process, according to the invention, for grinding out faults in the surface of a ferromagnetic workpiece by using a magnetizing means for the workpiece, a sensing device and/or recording device for responding to surface faults, a grinding device, which can be placed on the workpiece at the points where the faults occur, and a transport mechanism for moving the workpiece with respect to the sensing and/or recording device and the grinding device. The workpiece is checked for faults at two points arranged one behind the other and ground therebetween during passage in dependence of faults detected at the first checkpoint, this grinding process being repeated until no further fault is detected at the second checkpoint, the latter being arranged behind the grinding device.

In the process, according to the invention, the workpiece is checked section by section for faults and ground several times in dependence on the detected faults until the fault has been removed. As only the sections having faults, which could not be ground out in the first passage, are checked and ground several times without leaving the grinding area completely, it is thus ensured that no points which have faults remain unground. The treatment time for the entire workpiece is substantially shorter compared to other processes in which the workpiece has to be re-checked over its whole length and ground after a first grinding process. Conventional methods of detecting faults such as sensing by means of coils or indicating faults by scattering magnetic powder or applying emulsions on the workpiece, may be used.

An apparatus for carrying out the process having a magnetizing means, a control device, which responds to surface faults and is sensor controlled, and a grinding device, which is disposed after the sensing element means in the direction of movement of the workpiece, the latter being moved by a transport means, the grinding device being placeable on the surface of the workpiece, is characterized in that the control device has a sensing element ahead of the grinding device and a sensing element behind the grinding device in the direction of movement of the workpiece. Furthermore the first sensing element in the direction of movement of the workpiece controls the grinding device, and the second sensing element in that direction of movement returns the transport means to an extent so that upon detection of fault the detected fault is acted on by the first sensing element.

The process, according to the invention, can be carried out by an operator using the above auxiliary devices. However, it can also be fully automatized, the apparatus according to the present invention being an example. If the total width of the surface cannot be encompassed by the grinding device and the sensing elements on passing through, it is possible to subdivide the surface into individual longitudinal zones which are successively checked and ground. According to one embodiment of the invention, however, the first and second sensing elements may also consist of several sensing elements disposed adjacent to one another, which sensing elements are each allocated to one longitudinal zone on the workpiece, and these sensing elements may also transmit signals to the control means to activate the grinding device for the respective zone. The grinding device may be composed of several individual elements allocated to the individual zones. However, the grinding device may also be moved in a transverse direction to grind the corresponding zone.

BRIEF DESCRIPTION OF THE DRAWING

The invention is described below in greater detail by means of the sole FIGURE of the drawing showing a schematic representation of the apparatus.

DESCRIPTION OF THE PREFERRED EMBODIMENTS

The workpiece 1 to be treated, for example, a billet composed of ferromagnetic material, is moved by a transport means in the form of a carriage 2. The carriage 2 is equipped with a driving motor 3. A control device 4, which has one sensing element 6 and a second sensing element 7 in the direction of movement indicated by an arrow 5, is arranged above the workpiece 1. A grinding device 8, which is vertically movable by means of the control means 4 is disposed between the two sensing elements 6 and 7. The control device 4 controls both the vertical movement of the grinding device 8 and the driving motor 3.

To produce a magnetic stray flux on the surface of the workpiece 1, the workpiece is connected at its ends to a continuously controllable source of alternating current 9.

The apparatus according to the invention operates in the following manner:

When the workpiece 1, through which alternating current flows reaches the area of the control device 4, inhomogeneity—and thereby faults—are detected by the sensing element 6, which may, for example, be a coil for measuring the strength of magnetic fields. Taking into consideration the distance between the sensing element 6 and the grinding device 8, and also the velocity of movement of the workpiece 1, the control device 4 sets the grinding device 8 on the surface of the workpiece at the point where the fault is to be found, and the grinding device 8 grinds out the fault. This grinding process lasts as long as the fault is detected by the sensing element 6. When the fault has been completely removed by this grinding process, the sensing element 7 disposed behind the grinding device 8 does not respond. The movement of the workpiece 1 is therefore not halted. Various velocities of movement are obtainable by the control device 4 for areas free of faults and areas where faults occur. However, when the fault has not been completely removed by the grinding device 8 upon its first passage, the sensing element 7, which is constructed similarly to that of sensing element 6, responds and transmits a signal to the control device 4 to reverse the driving motor 3. The driving motor 3 then returns the transport device 2 with the workpiece 1 to an extent that the beginning of the fault which has been detected by the sensing device 7 will be disposed below the sensing device 6, so that the whole of the fault can be correctly acted upon by the grinding device 8. As the signal from the sensing element 7 has priority over the signal from the sensing element 6, reversal of movement occurs even when the grinding device 8 is still grinding. In this case the grinding process is interrupted during such a reversal.

Even if the fully automatic grinding out of faults is preferred, the establishing of faults directly in front of and behind the grinding device 4 also provides considerable advantages for manual control of the grinding device 4, as this method permits the faults to be completely removed in sections by an operator operating the grinding device 4 by remote control.

What is claimed is:

1. A process for grinding out faults on the surface of a ferromagnetic workpiece comprising the steps of:

placing a grinding device on the workpiece;

sensing surface faults in the magnetized workpiece by first and second sensing elements placed above first and second checkpoints;

grinding the sensed surface faults of the magnetized workpiece by the grinding device;

operatively and repeatedly transporting a workpiece in one direction with respect to the first and second sensing elements and the grinding device, and repeatedly transporting the workpiece in a direction opposite to the first direction;

testing the ground workpiece for faults at the first and second checkpoints, the first and second checkpoints being arranged in front of and behind the grinding device, respectively, with respect to the operative direction of movement of the workpiece; and additionally grinding the workpiece in dependence of the fault detected at the first checkpoint until no further fault is detected at the second checkpoint.

2. A process according to claim 1, wherein the workpiece has a plurality of sections, and further comprising the step of grinding the surface fault of the magnetized workpiece section by section.

3. A process according to claim 1, further comprising the step of controlling the velocity of transport of the workpiece.

4. A process according to claim 1, further comprising the step of moving the grinding device away from the workpiece when transporting the workpiece in the direction opposite to the first direction, and moving the grinding device to make contact with the workpiece when transporting the latter in the first direction.

5. A process according to claim 4, further comprising the step of controlling the movement of the grinding device remotely.

6. An apparatus for grinding out faults on the surface of ferromagnetic material comprising:

a grinding device placeable on the workpiece;

magnetizing means placeable in the vicinity of said workpiece for magnetizing the latter;

transport means for operatively moving the workpiece in one direction, the latter being placeable on said transport means, and for returning it in a direction opposite to the first direction; and control means, including first and second sensing elements, the latter elements being located ahead and in back of said grinding device, respectively, as seen in the operative direction of movement of the workpiece, the first sensing element controlling the placement of said grinding device on the workpiece, said second sensing element controlling the return movement of said transport means upon sensing a fault, in order that the fault on the workpiece can be ground and is subsequently detectable by said first sensing element.

7. An apparatus according to claim 6, wherein said transport means includes a carriage and a motor disposed on said carriage for driving the latter.

8. An apparatus according to claim 6, wherein said magnetizing means is a continuously controllable source of alternating current.

9. An apparatus according to claim 8, wherein the workpiece has two ends, and wherein said continuously controllable source of alternating current is connected to said ends.

10. An apparatus according to claim 6, wherein said sensing element is a coil for measuring the strength of a magnetic field.

* * * * *